United States Patent [19]

Bowles

[11] 3,955,633

[45] May 11, 1976

[54] DRILL

[75] Inventor: Raymond Ernest Bowles, West Preston, Australia

[73] Assignee: Mindrill Limited, Preston, Australia

[22] Filed: Apr. 26, 1974

[21] Appl. No.: 464,315

[52] U.S. Cl. ..... 175/258
[51] Int. Cl.[2] ..... E21B 9/26
[58] Field of Search ..... 175/258, 260, 261

[56] References Cited

UNITED STATES PATENTS

| | | | |
|---|---|---|---|
| 474,080 | 5/1892 | Bullock | 175/258 |
| 862,381 | 8/1907 | Bennerscheidt | 175/258 |
| 1,197,882 | 9/1916 | Woodand | 175/258 |
| 2,239,996 | 4/1941 | Chappell | 175/261 |
| 3,552,509 | 1/1971 | Brown | 175/258 |

*Primary Examiner*—James A. Leppink

[57] ABSTRACT

A drill in which a drilling apparatus is releasably mounted on the bottom of a drill string and on release can be withdrawn upwardly through the drill string by wire-line. The main cutting bit is disposed on the bottom end of the removable apparatus and the apparatus includes expandable cutters disposed above the main cutting bit to ream the hole cut by the main bit to permit the drill string to follow down the hole. The cutters are retracted for withdrawal of the apparatus.

5 Claims, 26 Drawing Figures

DRILL

BACKGROUND OF THE INVENTION

1. Field of the Invention

This invention relates to drilling and has particular, but not exclusive, application to core drilling.

2. Description of Prior Art

In core drilling an annular drill bit is employed and the core produced by this bit is recovered for examination. One type of core drill is such that the whole drill string must be withdrawn to recover a length of core. In another type the core is received within a core tube which forms part of a retractable assembly which can be drawn back through the drill string by means of a wire line without the necessity to remove the drill string from the hole.

The development of the wire line technique has greatly reduced the labor involved in drilling holes, in that many core lengths can be recovered without withdrawing the drill string. However it is still necessary to withdraw the whole drill string to examine and replace the cutting bit and when drilling in hard formations this procedure should be carried out quite frequently. If a drill bit is replaced before it has become worn too badly it will provide quite valuable salvage. However it has been found that, because of the work involved in withdrawing a complete drill string, the bits of wire-line drills are often operated until they are so badly damaged that salvage is negligible.

SUMMARY OF THE INVENTION

The present invention provides an apparatus which will enable drill bits to be withdrawn for examination and replacement without withdrawal of the complete drill string. The invention should find particular advantage in the field of wire-line core drilling but it could be applied to other forms of drilling as will be appreciated from the ensuing description.

The invention generally provides a drill comprising a tubular drill string and, releasably mountable on the bottom of the drill string, apparatus which comprises a body to rotate with the drill string, a cutting bit at the lower end of said body, a plurality of cutter elements arranged about the drill axis above the bit and movable between inner and outer positions, and holding means conditionable to hold the cutter elements in their outer positions, said apparatus being withdrawable through the drill string on release from the bottom end thereof when said cutters are in their inner positions and said cutters serving, when in their outer positions during drilling, to ream the hole cut by the bit to a size which suits the drill string.

More particularly the invention includes within its scope a core drill comprising a tubular drill string, and releasably mountable on the bottom of the drill string, apparatus comprising a body which is rotatable with the drill string and has an annular cutting bit at its lower end and a cavity to receive core cut by the bit, a plurality of cutter elements arranged about the drill axis above the bit and movable between inner and outer positions, and holding means conditionable to hold the cutter elements in their outer positions, said apparatus being withdrawable through the drill string on release from the bottom end thereof when said cutters are in their inner positions and said cutters serving, when in their outer positions during drilling, to ream the hole cut by the bit to a size which suits the drill string.

In order that the invention may be more fully explained one particular form of drilling apparatus embodying the invention will now be described in detail with reference to the accompanying drawings.

Figure 1A:
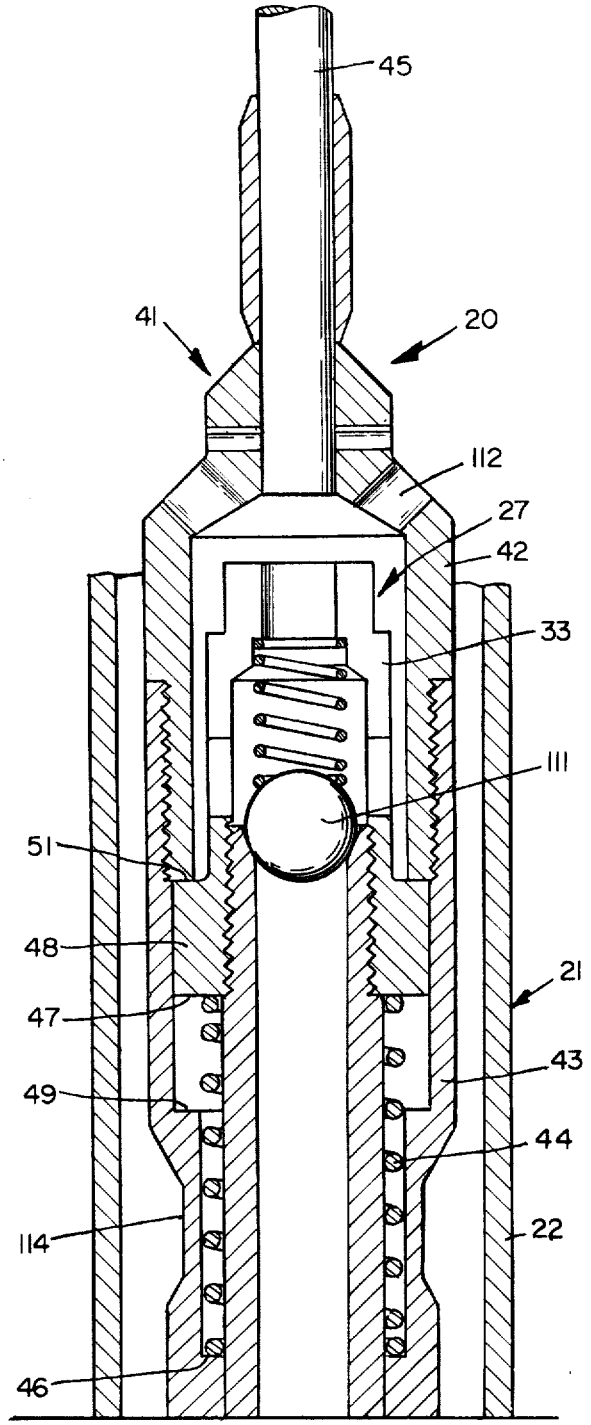
FIGS. 1A, 1B, 1C, 1D and 1E join to form a longitudinal cross-section through the bottom of a drill string and a drilling apparatus incorporating retractable cutter elements in accordance with the present invention, the cutter elements being shown in a retracted condition.
Figure 1B:
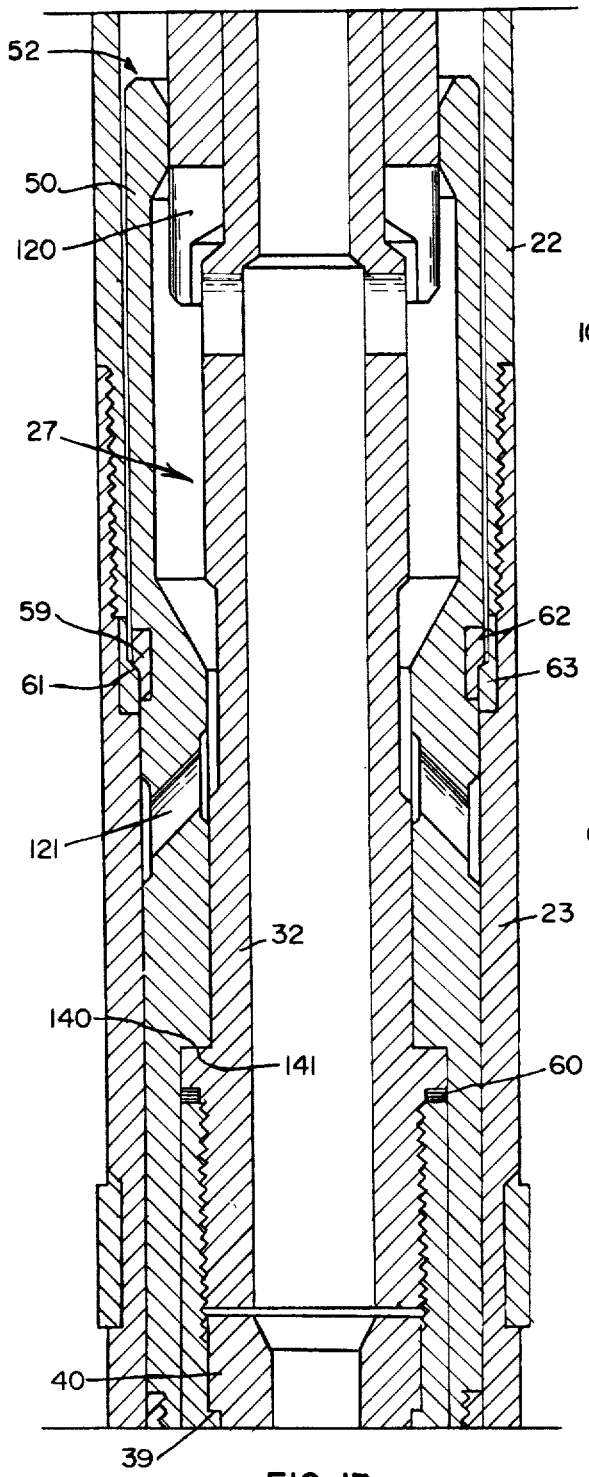

The drawings show a drill apparatus denoted generally as 20 disposed at the bottom end of a drill string 21. Drill string 21 is comprised of screw connected tubular drill rods 22, 23, 24 and terminates at a bottom end 26. Apparatus 20 extends downwardly below the bottom end of the drill string and includes as its bottom part a core barrel 25 fitted with an annular cutting bit 30 as will be described in more detail below.

Apparatus 20 includes a long central structure 27 comprising (from the bottom up) a cutter chocking member 28, an intermediate member 29, a tubular sleeve member 31 disposed around member 29, an upper tubular member 32 and a top member 33. These components are connected together so that the whole of structure 27 acts as one unit. The upper end of cutter chocking member 28 is formed to a spigot 35 which receives a smaller diameter spigot 34 formed in the lower end of intermediate member 29 and fits within the lower end of sleeve member 31. Pins 36 extend through holes 37 in spigot 35 and holes 38 in the lower end of sleeve 31 to fasten the members 28 and 31 together. The upper end of sleeve member 31 is screw connected to the lower end of upper tubular member 32 and the upper end of member 29 has an external flange 40 which is located beneath the bottom end of member 32 and rests on an upwardly facing internal shoulder 39 on member 31. There is a small clearance between the bottom end of member 32 and flange 40, this being determined by annular shims 60 disposed over the upper end of sleeve member 31. Shims 60 enable small vertical adjustments of the position of member 31 relative to member 32. The purpose of such adjustments will be described below. Top member 33 is screw connected to the upper end of tubular member 32 to complete the connection of the various components of the central structure into a single unit.

The upper end of the central structure 27 is fitted with a spear head assembly 41 comprising a spear head 45 pinned to a member 42 which is screw connected to a tubular member 43 slidable on the upper part of central structure 27. Spear head assembly 41 is capable of limited axial movement relative to central structure 27 against the action of a helical compression spring 44 acting between an upwardly facing internal shoulder 46 on member 43 and a downwardly facing shoulder 47 formed by the underside of a circumferential flange 48 on the top member 33 of central structutre 27. The axial movement of the spear head assembly relative to the central structure is limited by the location of flange 48 between shoulder 49 and a downwardly facing shoulder 51 defined by the bottom end of spear head member 42. Helical compression spring 44 will normally bias the spear head assembly downwardly relative to the central structure so that flange 48 is normally engaged with shoulder 51. The purpose of the relative movement bweteen the spear head assembly and the central assembly 27 will be explained below.

Apparatus 20 further comprises a long hollow body structure 52 the upper part of which is disposed around the central structure 27. This body structure comprises a top tubular part 50 screw connected at 54 to a long tubular part 53 which is screw connected at 56 to a further part 57 constituting an upper part of core barrel 25.

Core barrel 25 is of a conventional type and it is not fully detailed in the drawings. It has an outer tubular body portion 131 which is connected to part 57 and carries the main cutting bit 30, a core receiving inner tube 132 and a core lifter 55.

Figure 1E:
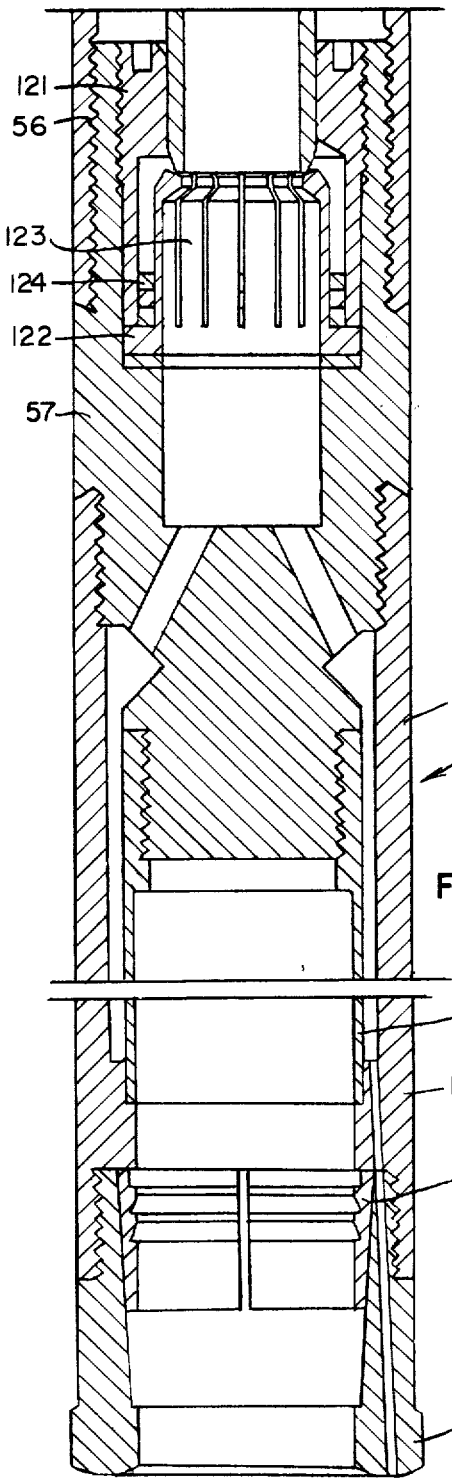
Figure 2E:
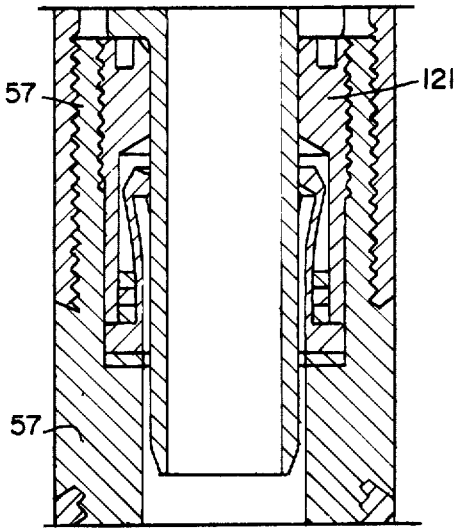
FIGS. 2A, 2B, 2C, 2D and 2E join to form a longitudinal cross-section similar to that formed by FIGS. 1A to 1E but showing the apparatus in a condition in which the cutter elements are extended outwardly.
Figure 2A:
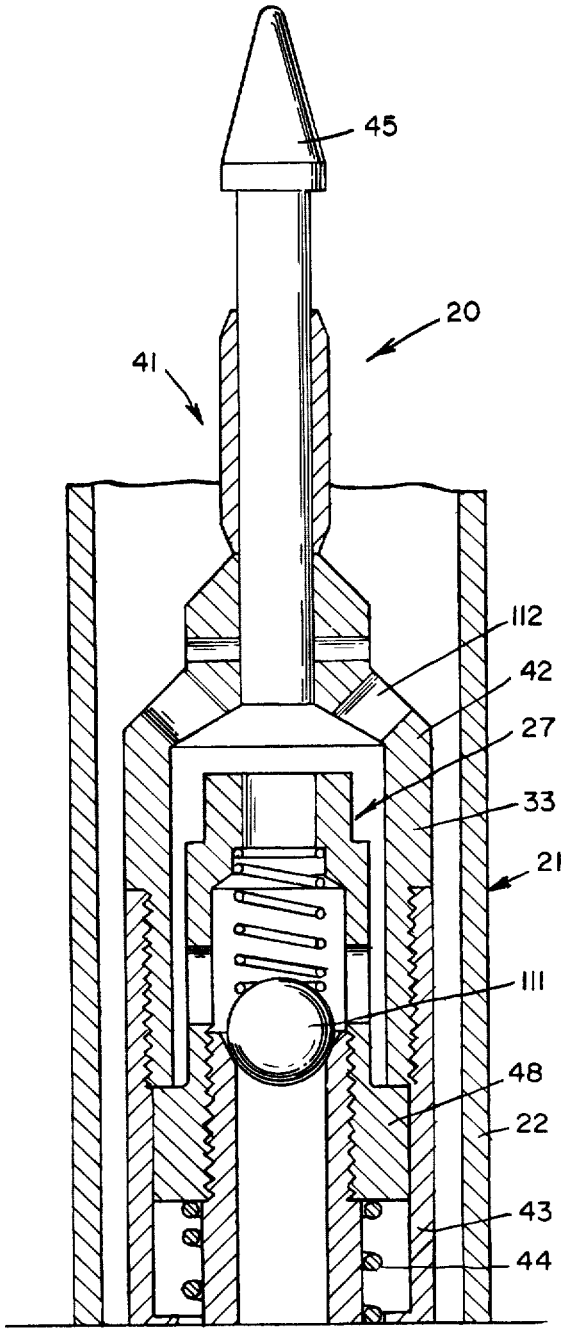
Figure 2B:
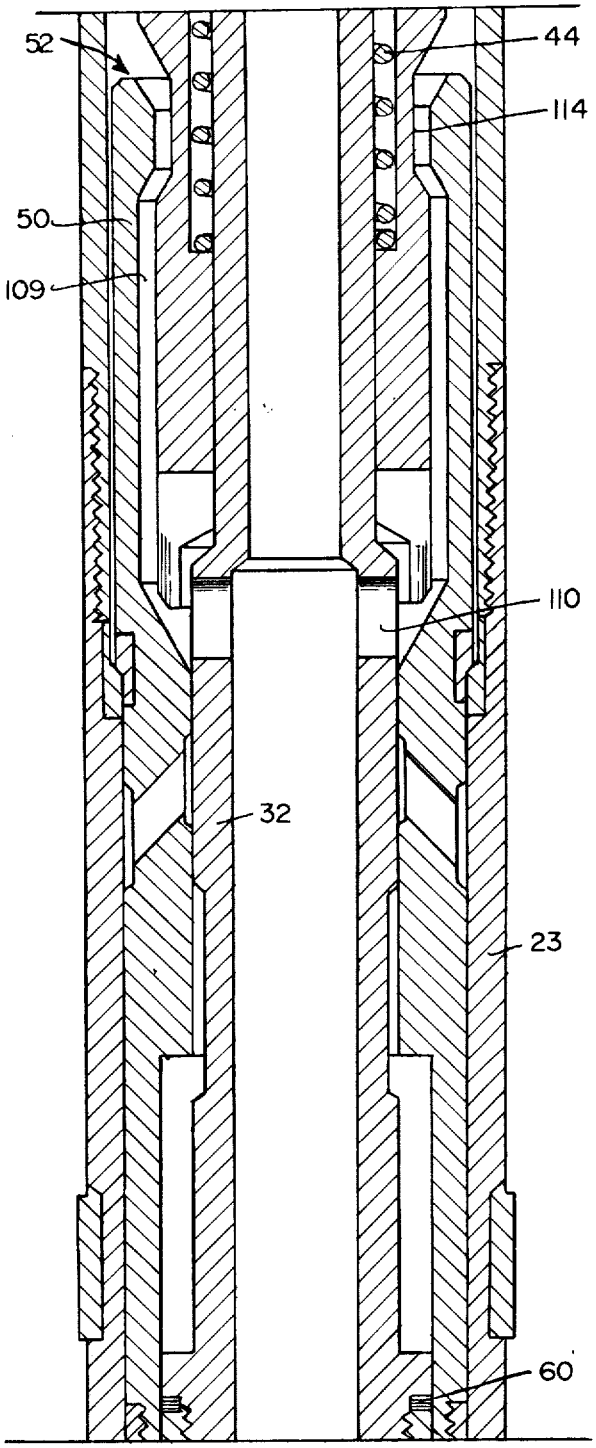
Figure 14:
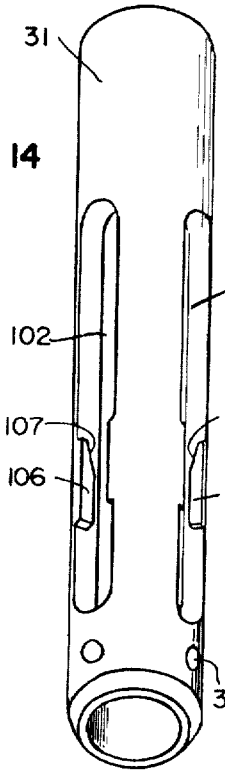
FIGS. 13 and 14 are perspective views of two of the components seen in FIGS. 1C and 2C.
Figure 2C:
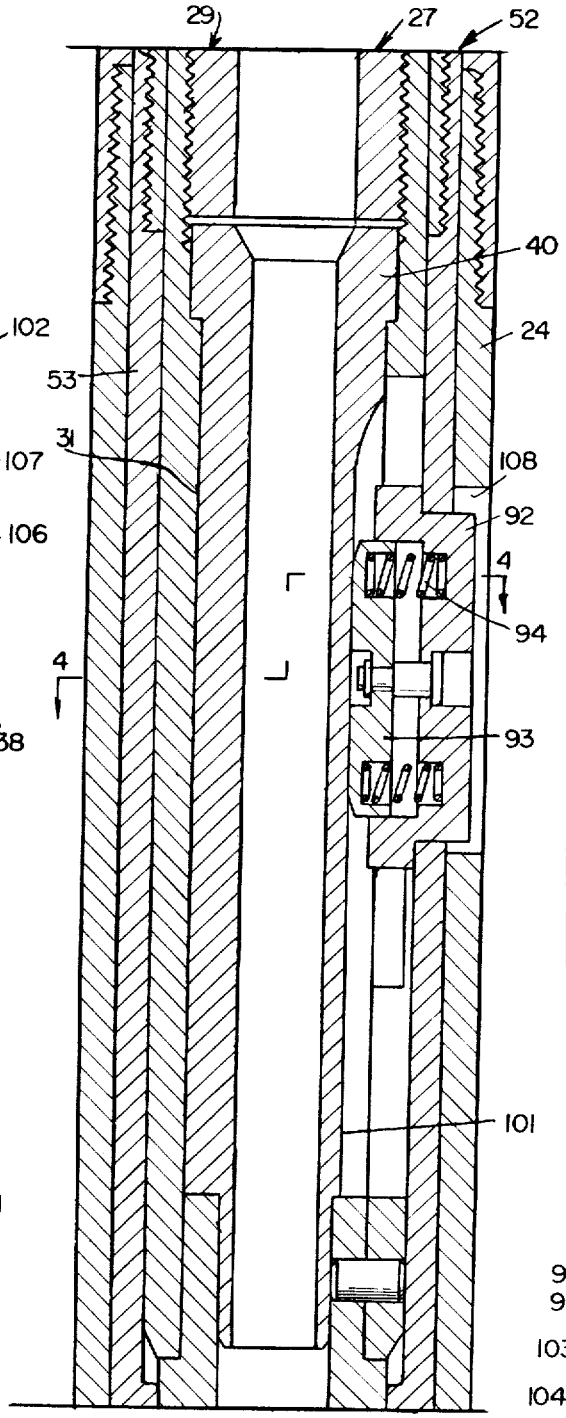
Figure 12:
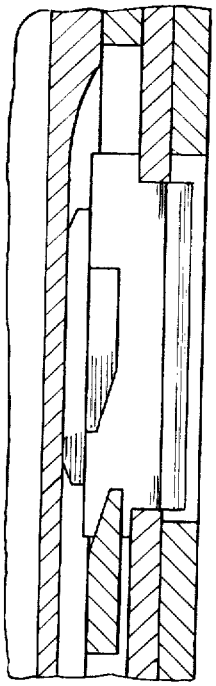
FIG. 12 is a longitudinal cross-section corresponding to FIG. 11 but showing the respective components when the apparatus is in the condition illustrated by FIGS. 2A to 2E.
Figure 13:
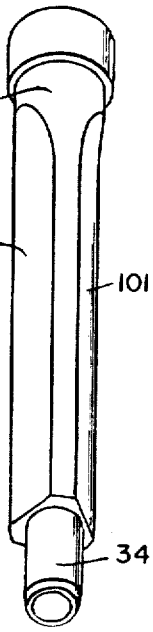
Figure 15:
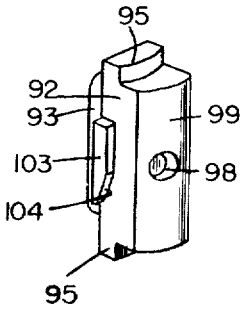
FIG. 15 is a perspective view of one of three rotary drive dogs of the apparatus.
Figure 17:
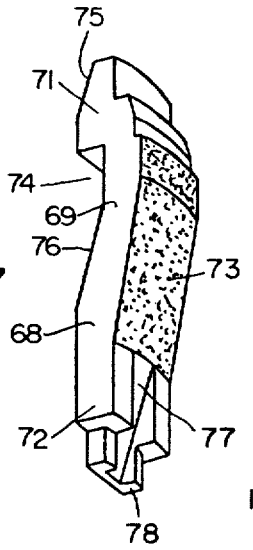
FIG. 17 is a perspective view of one of three cutter elements of the apparatus.

The lower end of member 28 of central structure 27 is slidable within a sleeve 121 screw fitted into the upper end of body member 57 and is engaged by a detent ring 122 clamped between sleeve 121 and member 57. Ring 122 has a plurality of upwardly projecting fingers 123 which can engage the bottom end of member 28 as shown in FIG. 1E to resist downward movement of central structure 27 but can be spread apart to permit the bottom end of member 28 to slide downwardly through it as shown in FIG. 2E if sufficient downward force is applied to structure 27. By adding to or removing from a series of rings 124 placed around fingers 123 the stiffness of the fingers can be varied to adjust the checking action of the detent ring.

Body part 50 is formed with a downwardly facing inclined shoulder 59 which engages an upwardly facing similarly inclined shoulder 61 on the inside of the drill string when the apparatus is in position down a drill hole. As shown in the drawings shoulders 59, 61 may be defined by hard wearing annular rings 62, 63 fitted to body part 50 and drill string tube 23 respectively.

Figure 18:
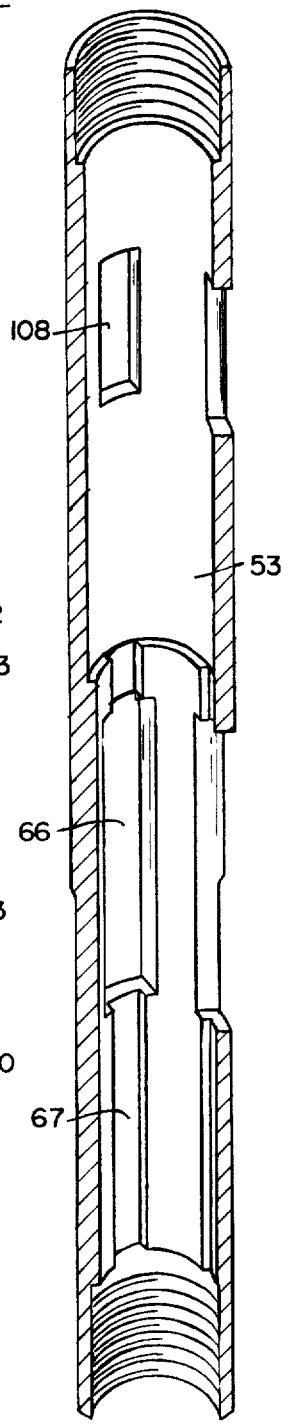
FIG. 18 is a broken perspective view of a tubular body component of the apparatus.
Figure 1C:
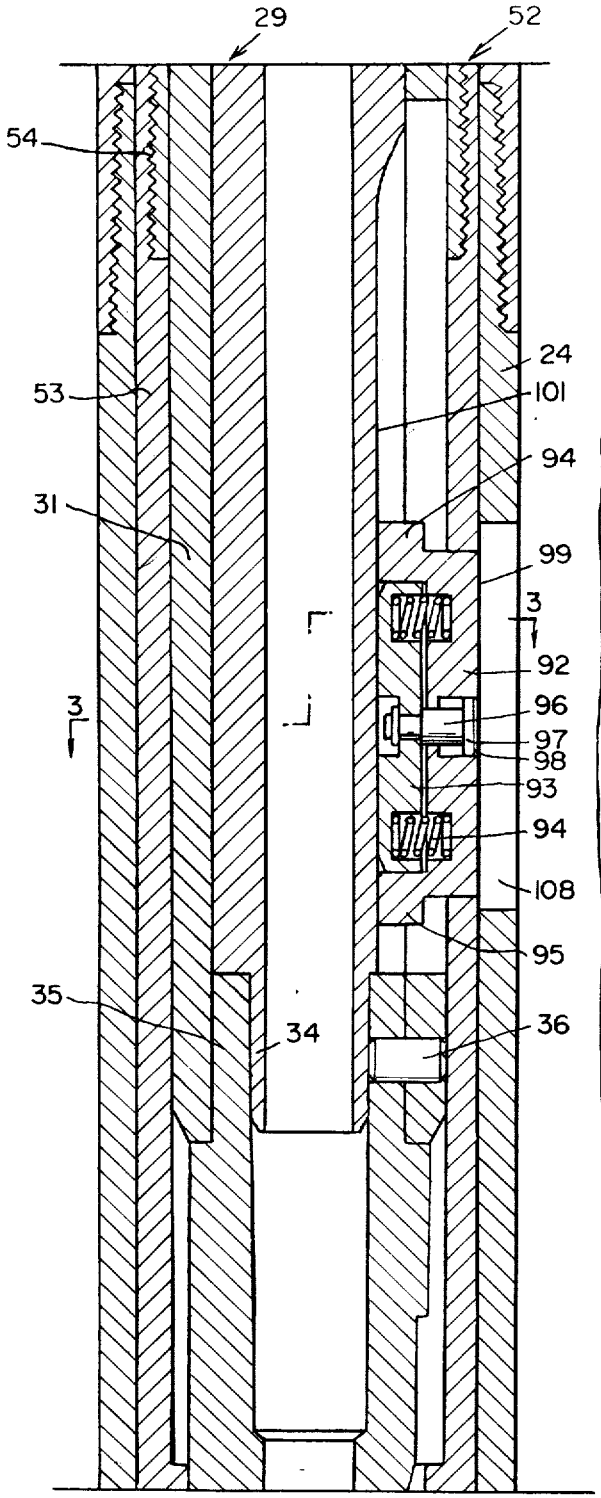
Figure 11:
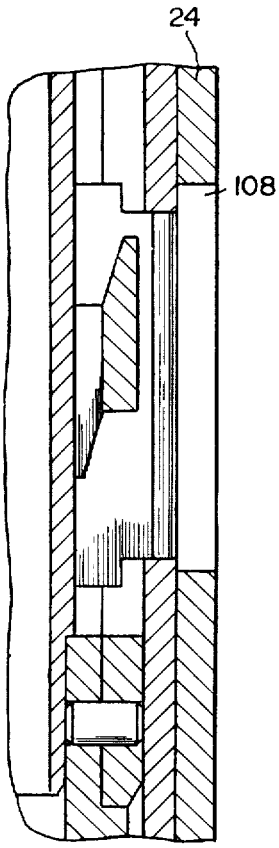
FIG. 11 is a longitudinal cross-section through certain parts of the apparatus shown in FIG. 1C but taken in a plane spaced circumferentially of the sectioning plane of FIG. 1C.

The construction of main body part 53 may be seen from FIGS. 1C and 18. It is essentially a long cylindrical tube in the upper part of which there are three circumferentially spaced longitudinally extending slots 64 and in a lower part of which there are three rather longer circumferentially spaced slots 66 and three internal vertical grooves 67 extending above and below slots 66.

Three cutter elements 68 are disposed in the slots 66 of the main body part 53 and are engaged by the cutter chocking member 28 of central structure 27 so that they can be moved between outwardly extended positions and retracted positions by vertical movement of the central structure within body structure 52. Each cutter element 68 has a midpart 69 disposed between an upper head portion 71 and a lower portion 72. Midpart 69 is fitted with a diamond encrusted insert 73 providing an outer cutting face and its inner face is provided with a notch 74. The lower face 76 of notch 74 and a similarly inclined face 75 on the underside of head portion 71 serve as internal ramp surfaces and the bottom portion 72 is formed with a downwardly and inwardly inclined external ramp face 77. The extreme lower end of bottom portion 72 is in the form of a generally channel shaped tail 78.

Figure 16:
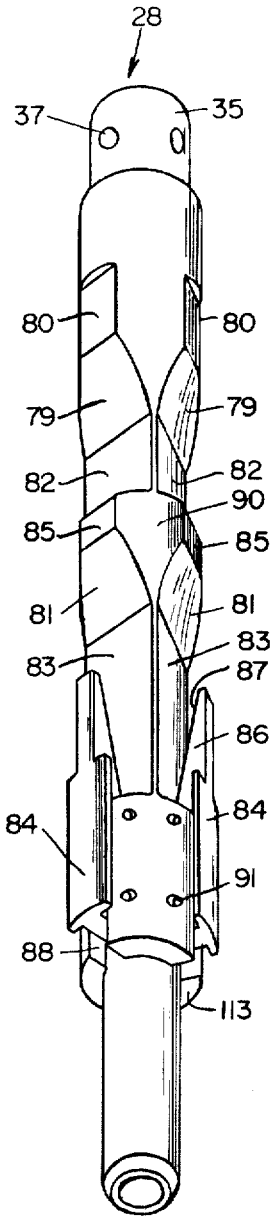
FIG. 16 is a perspective view of one of the components of the apparatus seen in FIGS. 1D and 2D.
Figure 1D:
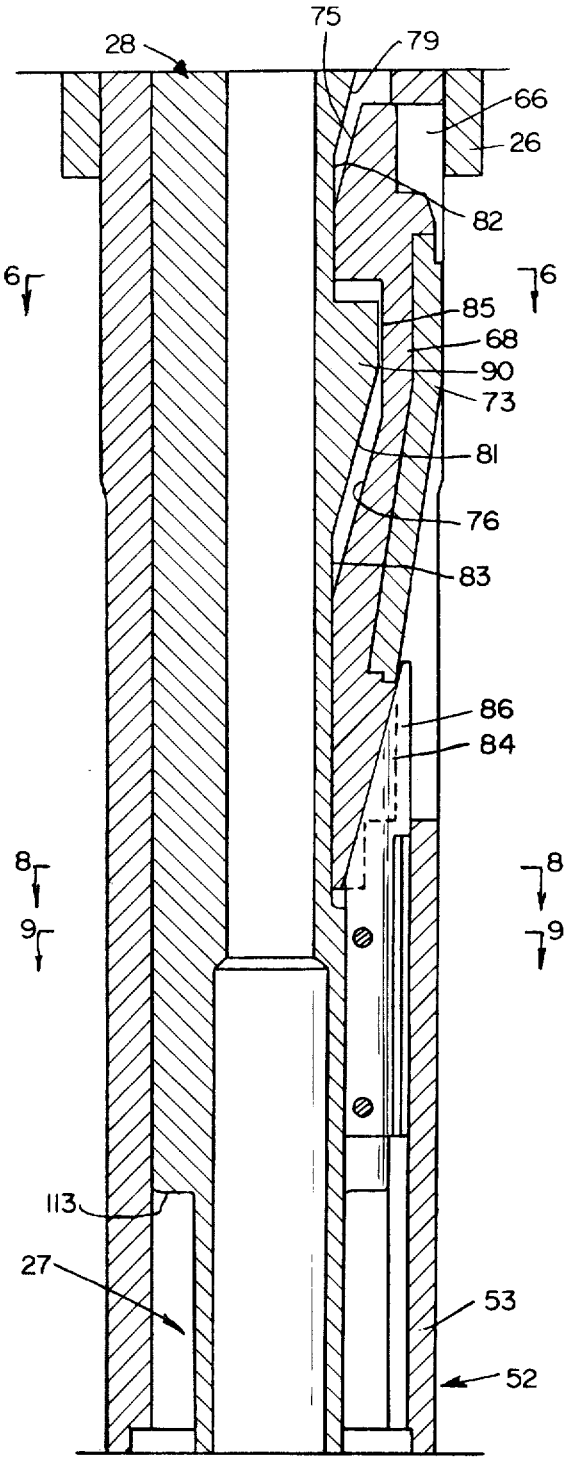
Figure 2D:
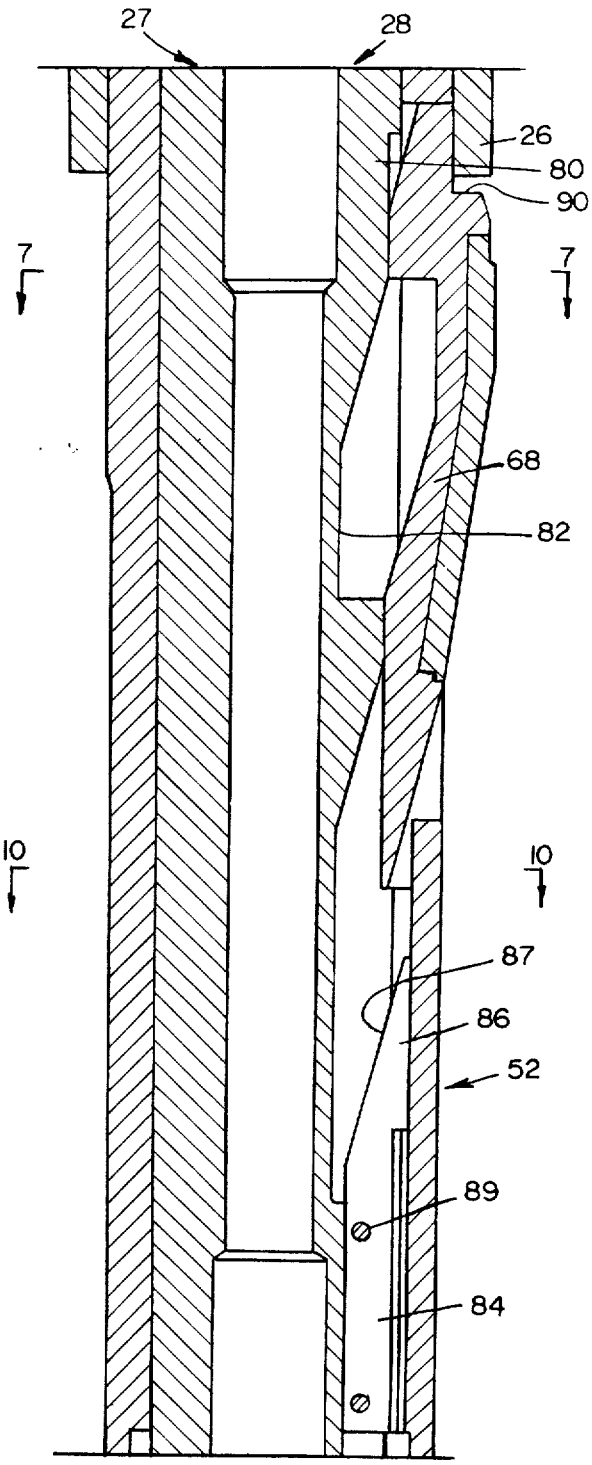

The construction of the cutter chocking member 28 of central structure 27 may be seen from FIGS. 1D, 2D and 16. It is machined from tubular stock to a complex shape so as to have an upper set of downwardly and inwardly inclined flat ramp surfaces 79 and a lower set of similar ramp surfaces 81, there being three surfaces in each set. Ramp surfaces 79 extend downwardly from outer vertical surfaces 80 to inner vertical surfaces 82 and ramp surfaces 81 extend downwardly from outer vertical surfaces 85 to inner vertical surfaces 83. The two sets of vertical surfaces 82, 83 are aligned with one another and are separated by a knob part 90 which includes the surfaces 81, 85.

Below surfaces 83 member 28 is fitted with three cutter retractor finger members 84 the upper parts of which define upwardly extending fingers 86 having downwardly and inwardly inclined inner edges 87. The lower parts of finger members 84 are of generally T-shaped cross-section and their central webs fit into three circumferentially spaced longitudinally extending slots 88 machined in member 28 and are held in position by fixing pins 89 extending through those webs and located within holes 91 drilled in member 28 to extend transversely of slots 88. The outer flanges of members 84 slide in the grooves 67 of body part 53.

Central structure 27 is movable vertically within body structure 52 between an upper position as shown in FIGS. 1A to 1E and a lowered position as shown in FIGS. 2A to 2E. When the central structure is in the raised position cutter elements 68 are retracted as shown in FIG. 1D. When the cutter elements are in this condition their inner notches 74 receive the knob part 90 of member 28 as shown in FIG. 1D so that the head portions 71 of the cutter elements engage the flat surfaces 82 of member 28 and the bottom parts 72 of the cutters engage the flat surfaces 83. The cutters are held in this retracted condition by engagement of the inner edges 87 of fingers 86 with the bottom external ramp surfaces 77 of the cutter elements.

Figure 10:
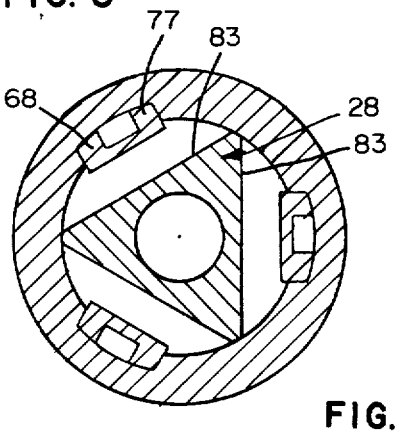
FIG. 10 is a cross-section on the line 10—10 in FIG. 2D.

When central structure 27 is moved downwardly the upper ramp faces 79 of member 28 engage the upper ramp surfaces 75 of the cutter elements and the lower ramp surfaces 81 of member 28 engage lower ramp surfaces 76 of the cutter elements so that the cutter elements are wedged outwardly. Central structure 27 can move downwardly until the head portions 71 of the cutter elements ride onto flat surfaces 80 on member 28 above ramp surfaces 79 and the lower parts of the cutter elements ride onto the flat surfaces 85 on the knob part 90 of that member as shown in FIG. 2D. The bottom tails 78 of the cutters are then received in the upper ends of slots 67 of body member 53 as shown in FIG. 10 and the ends of the cutter heads 71 are located within the bottom end 26 of the drill string.

Slots 108 in the upper part of body member 53 receive three rotary drive dogs 92 fitted with spring loaded pressure pads 93. Dogs 92 are shaped as elongate blocks the two ends of which are notched to form longitudinally projecting tongues 95 and the inner faces of which are recessed to receive the pressure pads 93. The spring loading of the pressure pads is provided by helical compressing springs 94 and the dogs and pressure pads are held together by retaining pins 96 having enlarged heads 97 which can slide in bores 98 in the outer faces 99 of the dogs.

Member 29 of central structure 27 has three flat surfaces 101 disposed in triangular array and extending throughout a major part of the length of member 29. These flat surfaces are disposed radially inwardly from three longitudinally extending slots 102 in upper tubular member 31 of central structure 27 and dogs 92 extend inwardly through slots 102 so that their pressure pads 93 bear against the flat surfaces 101 of member 29. More particularly the dogs make sliding engagement with slots 102 and flat surfaces 101 slide over pressure pads 93 as the central structure 27 is moved vertically relative to the outer body structure 52.

Figure 3:
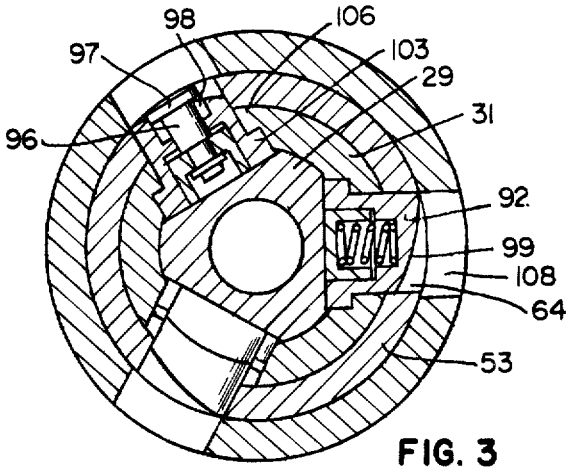
FIG. 3 is a cross-section on the line 3—3 in FIG. 1C.

The two side edges of each dog 92 are fitted with cam plates 103 having downwardly and inwardly sloping ramp surfaces 104 and complementary cams 106 with downwardly and inwardly inclined ramp surfaces 107 project from the side walls of slots 102 in member 31. When central structure 27 is in its raised position cams 106 are in engagement with the cam plates 103 of the dogs to hold the dogs in retracted positions, shown in FIGS. 1C and 3, in which they cannot project radially outwardly from member 53 of the body structure 52. When the central structure 27 is moved downwardly, however, the cams 106 are moved downwardly away from the cam plates 103 on dogs 92 and the dogs can then be moved outwardly by the action of springs 94.

Figure 5:
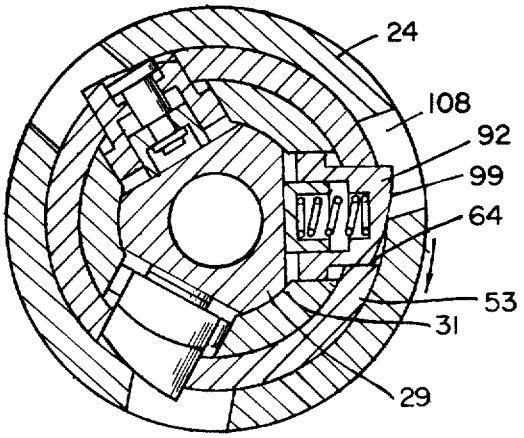
FIG. 5 is a cross-section similar to that of FIG. 4 but shows certain components of the apparatus in a different angular disposition.
Figure 4:
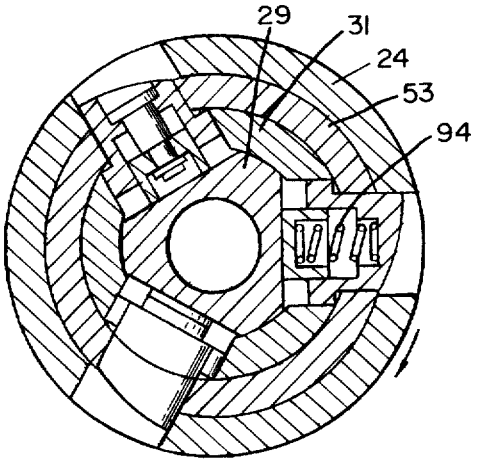
FIG. 4 is a cross-section on the line 4—4 in FIG. 2C.
Figure 6:
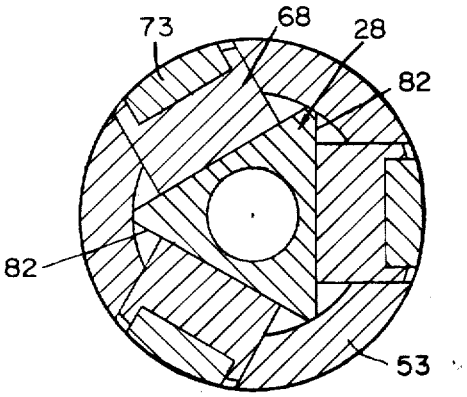
FIG. 6 is a cross-section on the line 6—6 in FIG. 1D.
Figure 7:
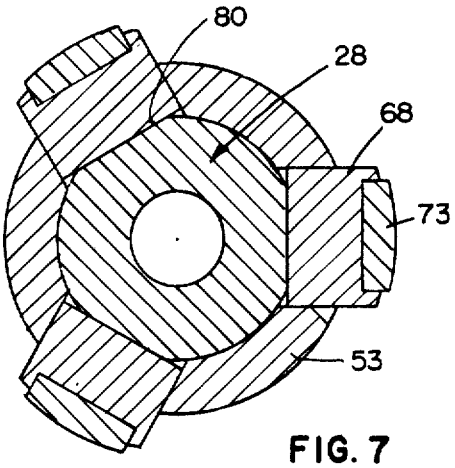
FIG. 7 is a cross-section on the line 7—7 in FIG. 2D.
Figure 8:
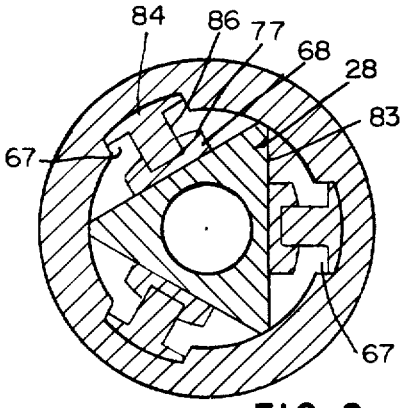
FIG. 8 is a cross-section on the line 8—8 in FIG. 1D.
Figure 9:
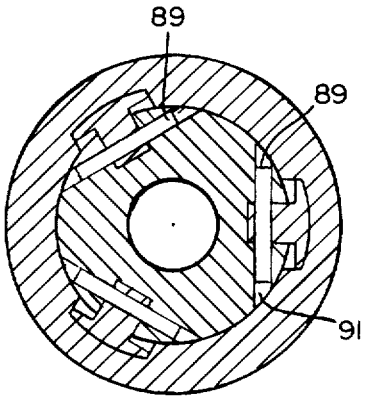
FIG. 9 is a cross-section on the line 9—9 in FIG. 1D.

Three vertical slots 108 are formed in drill string tube 24 to interengage with drive dogs 92 in the manner shown in FIGS. 1C and 4 to provide a rotary drive coupling between the drill string and the apparatus 20. The construction of the drive dogs is such that they do not need to be angularly aligned with slots 108 when the apparatus 20 first lands at the bottom of the drill string and before the drill string is rotated. In fact in most instances the dogs will initially be circumferentially displaced from slots 108. They will then be biased outwardly by springs 94 against the inner face of drill string tube 24 between slots 108 and they will slide around the drill string tube as it begins to rotate until they can snap into engagement with slots 108. To assist the engagement of the dogs with slots 108 the outer faces 99 of the dogs are inclined to the circumferential direction so that their front side faces which face against the direction of rotation of the drill string project outwardly further than the opposide side faces and their front parts can project into slots 108 before the dogs reach complete alignment with the slots. This is illustrated in FIG. 5 from which it will be appreciated that by the time the dogs reach proper alignment with slots 108 their leading faces have already penetrated the slots to a considerable extent and the dogs cannot "overshoot" the slots. The outer faces 99 may be curved as shown to enable them to slide smoothly on the respective edges of slots 108.

In accordance with the present invention core barrel 25 is of a smaller size than would normally be connected to the lower end of the drill string 21. Specifically it is of such a size that it can be withdrawn back through the drill string when the cutter elements 68 of the apparatus 20 are retracted and the cutter elements serve to ream the hole cut by main cutting bit 30 so as to permit the relatively large drill string 21 to follow down the hole.

During drilling apparatus 20 is in the condition shown in FIGS. 2A to 2E and is latched against upward movement by the interference between the head portions 71 of cutter elements 68 and the bottom end 26 of the drill string. Water then flows to the core barrel by passing downwardly along the annular clearance space 109 between the upper end of body structure 52 and the central structure 27 then through water ports 110 and the interior of central structure 27 and thence to the core barrel. Drilling thrust is transmitted from the bottom end of the drill string onto shoulders 90 of cutters 68 and through the cutters onto body member 53 through which it is transmitted to the core barrel body to the main bit 30. Torque is taken from the drill string by dogs 92 and transmitted via tubular body member 53 to both the cutters 92 and the core barrel body.

When apparatus 20 is to be withdrawn the core which has been drilled must firstly be broken. This is achieved by lifting the drill string through a small distance. Because of the interengaging shoulders 59, 61 the whole of apparatus 20, including the core barrel, is lifted and the core lifter 55 acts in conventional manner to break the core. The spear head member 42 is then grappled with a wireline overshot and the wire-line is retracted. The spear head assembly 41 initially moves upwardly relative to central structure 27 against the action of spring 44 to the extent limited by engagement of flange 48 with shoulder 49 after which the whole of central structure 27 is moved upwardly so that cutter elements 68 and rotary drive dogs 92 are retracted to such an extent that the whole of apparatus 20 will fit within the drill string 21 and further retraction of the wire-line causes the whole of apparatus 20 to be drawn up through the drill string. The purpose of shims 60 is to ensure that during lifting there is a slight clearance between the cutters 68 and the cutter retractor finger members 84 so that the lifting force is transmitted from the central structure 27 to the outer structure 52 through interengaging shoulders 140, 141 on members 32 and 50. If this clearance were not provided the lifting force could be applied to the retractor finger members 84 which could result in shearing of their fixing pins 89. The number of shims may need to be altered during service, particularly after replacement of the retractable cutters.

The lower end of the tubular member 43 of the spear head assembly has radial slots 120 and when the spear head assembly is raised against the action of spring 44 these slots traverse the upper end of body member 50 to serve as water passages through which water can flow downwardly into the upper end of body member 50 and to water ports 121, extending through the wall of that member. After the apparatus has been lifted a short distance water ports 121 are raised above the shoulders 61 to enter the relatively larger diameter main part of the drill string and the water will flow through ports 121 and down the annular clearance space between the body structure and the drill string. When the whole apparatus is lifted into the main part of the drill string this annular clearance space provides a water bypass passage to the bottom of the hole so that considerable relief of the head of water above the apparatus is achieved.

When lowering apparatus 20 down the drill string, central structure 27 is moved to its raised position and the whole assembly is then either dropped or lowered down the hole. If the assembly is lowered on the wire-line spring 44 will be compressed and there is upward water relief via the water ports 121, the interior of body structure 52 and outwardly through slots 120. If the assembly is simply dropped down the hole, water is relieved via the interior of central structure 27 and a spring loaded ball valve 111 and ports 112 in the spear head assembly 41. In both cases detent ring 122 will hold the central structure in its raised position relative to body 52 against the influence of inertia forces which can be generated as the apparatus meets obstructions in its passage down the drill string and when it "lands" on shoulder 61.

After it lands at the bottom of the drill string apparatus 20 adopts the condition shown in FIGS. 1A to 1E. When in this condition the spear head assembly 41 is biased downwardly relative to central structure 27 by spring 44 so that the lower end of member 43 is within the upper end of the tubular member 50 of body structure 52 to block the annular water passage 109. Inner structure 27 can then be pumped downwardly against the action of detent ring 122 by the application of fluid pressure until a downwardly facing shoulder 113 on the member 28 of the central structure engages the upper end of sleeve 121 by which time the upper end of the tubular member 53 of outer body structure 52, which has been sliding on member 43 of the spear head assembly, reaches a circumferential groove 114 in member 43 to open the annular passage 109 for flow of water to the core barrel. By this stage the cutter elements will have been driven outwardly and will be held chocked in their outer positions. The dogs 92 will have been freed so as to be biased outwardly by springs 94. When water passage 109 is opened the operator will observe a change in water pressure and will know that the apparatus is latched in position. The drill string is then rotated and dogs 92 interengage with slots 108 in the drill string to couple apparatus 20 to the drill string and so rotate both the main bit 30 and the reaming cutters 68.

The illustrated apparatus is most convenient in operation and permits replacement of the retractable cutters and the main cutting bit without removal of the drill string. The retractable cutters can be very simply removed after retrieval of the apparatus from the drill hole. The central structure 27 is pushed downwardly by hand to chock the cutters outwardly and because the drill string is then not present to retain the upper ends of the cutters they can simply be removed and replaced. The apparatus is not limited in use to core drilling operations and core barrel 25 could be replaced by a solid drilling bit. Moreover many of the components of the central structure 27 and the outer body 52 could be varied considerably. It is accordingly to be understood that the invention is not limited to the illustrated details and that many modifications and variations will fall within the scope of the appended claims.

I claim:

1. A drill comprising:

a tubular drill string having a series of circumferentially spaced slots adjacent its lower end; and an apparatus releasably mountable on the bottom of said drill string, said apparatus having a body rotatable with said drill string, a cutting bit at the lower end of said body, a plurality of cutters arranged about the drill axis above said bit and movable between inner and outer positions, said cutters serving, when in their outer positions during drilling, to ream the hole cut by said bit to a size which permits said drill string to pass along the reamed hole, a structure movable vertically with respect to said body between a first position and a second position, said structure chocking said cutter elements in said outer positions when said structure is in said first position but permitting retraction of said cutter elements to their inner positions when it is moved to said second position, a plurality of rotary drive dogs each movable between an outer position in which to engage said drill string and said body so as to provide a torque coupling between said drill string and said body and a retracted position in which said dogs are disengaged from said drill string, each of said rotary drive dogs being provided with a slidable cam means engagable with a complementary cam means on said structure to cause the retraction of said dogs on movement of said structure from said first position to said second position so that said apparatus is withdrawable through said drill string on release from the bottom end thereof when said cutters are in said inner positions and said rotary drive dogs are retracted, and biasing means to bias each dog outwardly when said structure is in said first position, whereby in the event that said structure is moved to said first position when said drive dogs are circumferentially displaced from alignment with said slots, said drive dogs are forced outwardly by said biasing means into engagement with said slots on rotation of said drill string.

2. A drill as claimed in claim 1, wherein said structure is a central structure movable vertically within said body the drive dogs are disposed in slots in said body and said biasing means comprises spring loaded pressure pads acting against and slidable on said structure.

3. A drill as claimed in claim 1, wherein said first position of said structure is a lowered position relative to the body and said second position is a raised position relative to the body.

4. A drill as claimed in claim 3, wherein upward vertical movement of said structure relative to the body is limited and the upper end of that structure is provided with a spear head to enable withdrawal of the apparatus by wire-line technique.

5. An apparatus releasably mountable adjacent the bottom of a drill string, said apparatus comprising:

a body rotatable with said drill string;

a cutting bit at the lower end of said body;

a plurality of cutters arranged about the drill axis above said bit and movable between inner and outer positions, said cutters serving, when in their outer positions during drilling, to ream the hole cut by said bit to a size which permits said drill string to pass along the reamed hole;

a structure movable vertically with respect to said body between a first position and a second position, said structure chocking said cutter elements in said outer positions when said structure is in said first position but permitting retraction of said cutter elements to their inner positions when it is moved to said second position;

a plurality of rotary drive dogs each movable between an outer position for engaging a series of circumferentially spaced slots in the drill string and said body so as to provide a torque coupling between the drill string and said body and a retracted position in which it is disengaged from the drill string, each of said rotary drive dogs provided with a slidable cam means engagable with a complementary cam means on said structure to cause the retraction of said dogs on movement of said structure from said first position to said second position so that said apparatus is withdrawable through the drill string on release from the bottom end thereof when said cutters are in said inner positions and said rotary drive dogs are retracted; and biasing means to bias each dog outwardly when said structure is in said first position, whereby when said structure is used with the drill string, said drive dogs are forced outwardly by said biasing means into engagement with the slots on rotation of the drill string.

* * * * *